US010570898B2

(12) United States Patent
Shaw et al.

(10) Patent No.: US 10,570,898 B2
(45) Date of Patent: Feb. 25, 2020

(54) MODULARIZED INTEGRATED NON-COAXIAL MULTIPLE CHAMBER DRY VACUUM PUMP

(71) Applicants: Raymond Zhou Shaw, Shanghai (CN); Elivac Company, Ltd. (Suzhou), New Sci-Tech, Taicang Suzhou Jiangsu (CN); Elivac Company, Ltd. (Shanghai), Baihe County, Qingpu District, Shanghai (CN)

(72) Inventors: Raymond Zhou Shaw, Shanghai (CN); Yi Rong, Shanghai (CN)

(73) Assignees: Elivac Company, Ltd. (Shanghai), Shanghai (CN); Raymond Zhou Shaw, Shanghai (CN); Elivac Company, Ltd. (Suzhou), Jiangsu (CN)

( * ) Notice: Subject to any disclaimer, the term of this patent is extended or adjusted under 35 U.S.C. 154(b) by 0 days.

(21) Appl. No.: 15/882,980

(22) Filed: Jan. 29, 2018

(65) Prior Publication Data

US 2018/0149156 A1 May 31, 2018

Related U.S. Application Data

(63) Continuation-in-part of application No. PCT/CN2015/091077, filed on Sep. 29, 2015.

(30) Foreign Application Priority Data

Aug. 27, 2015 (CN) ..... 2015 1 0533070

(51) Int. Cl.
*F04C 23/00* (2006.01)
*F04C 18/12* (2006.01)
(Continued)

(52) U.S. Cl.
CPC ..... *F04C 23/001* (2013.01); *F04C 18/126* (2013.01); *F04C 28/02* (2013.01);
(Continued)

(58) Field of Classification Search
CPC .. F04C 23/001; F04C 11/001; F04C 29/0085; F01C 21/007
(Continued)

(56) References Cited

U.S. PATENT DOCUMENTS 5,378,128 A * 1/1995 Yanagisawa ..... F04C 23/001 184/13.1
9,273,568 B2 * 3/2016 Suzuki ..... F01C 21/10
(Continued)

FOREIGN PATENT DOCUMENTS

GB 797311 A * 7/1958 ..... F04C 23/001
GB 797311 A * 7/1958 ..... F04C 23/001

*Primary Examiner* — Deming Wan
(74) *Attorney, Agent, or Firm* — Michael D. Eisenberg

(57) ABSTRACT

A modularized integrated non-coaxial multiple chamber dry vacuum pump is formed by at least two modularized vacuum chambers that can be integrated into a solid multiple stage dry vacuum pump. These chambers are connected in serial to allow gas to pass through and be discharged directly to the atmosphere. Each chamber contains a pair of lobes of its own and at least one chamber does not share at least one coaxial axle with another chamber. At least two chambers do not share all co-axial(s) and can have their own power drive at different RPMs from either different motors or transmissions.

20 Claims, 8 Drawing Sheets

(51) Int. Cl.

| | |
|---|---|
| ***F04C 11/00*** | (2006.01) |
| ***F01C 21/00*** | (2006.01) |
| ***F04C 28/02*** | (2006.01) |
| ***F04C 28/08*** | (2006.01) |
| ***F04C 29/00*** | (2006.01) |
| *F04C 25/02* | (2006.01) |
| *F04C 29/04* | (2006.01) |
| *F04C 29/12* | (2006.01) |

(52) U.S. Cl.
CPC ..... *F04C 28/08* (2013.01); *F04C 29/0085* (2013.01); *F04C 25/02* (2013.01); *F04C 29/005* (2013.01); *F04C 29/04* (2013.01); *F04C 29/12* (2013.01); *F04C 2240/70* (2013.01)

(58) Field of Classification Search
USPC ..... 418/5, 9, 10, 196, 197, 199, 201.1, 215, 418/16, 209
See application file for complete search history.

(56) References Cited

U.S. PATENT DOCUMENTS

2004/0081565 A1* 4/2004 Kuramoto ..... F01C 21/007 417/360
2006/0222506 A1* 10/2006 Rival ..... F04C 23/001 417/2
2014/0112815 A1* 4/2014 Kudara ..... F04C 25/02 418/9

* cited by examiner

Vertical Layout Application

MODULARIZED INTEGRATED NON-COAXIAL MULTIPLE CHAMBER DRY VACUUM PUMP

CROSS-REFERENCES TO RELATED APPLICATIONS

The present application is a continuation in part of PCT/CN2015/091077 filed Sep. 29, 2015, which claims priority from Chinese Patent Application No. 201510533070.8, filed Aug. 27, 2015, which are each hereby incorporated herein by reference in their respective entirety.

TECHNICAL FIELD

This invention relates to a Modularized Integrated Non-Coaxial Multiple Chamber (MINCMC) dry vacuum pump.

BACKGROUND OF THE INVENTION

There are many types of vacuum pumps in various industries including: chemical, pharmaceutical, tobacco, coating, steel refinery, degassing, electrical, packaging, power generation, semiconductor, and many more. Specific examples include: liquid ring pumps, kinetic pumps, vane pumps, rotary piston pumps, reciprocating pumps, screw pumps, claw pumps, scroll pumps, multistage roots pumps, pre-inlet air cool roots pumps, and roots pump. However, among these pumps, the ordinary roots pump cannot discharge directly to the atmosphere. It must have one of the aforementioned pumps as its backing pump.

Among the pumps mentioned above, depending on the presence of water or other liquid involved directly with the process gas in the pump operation, there are basically two types of pumps: dry vacuum pumps and water/liquid vacuum pumps. As environmental protection becomes a larger concern for society, dry vacuum pumps are increasingly demanded by all industries. Reciprocating pumps, screw pumps, scroll pumps, vane pumps, multi-stage roots pumps, claw pumps and pre-inlet air cooling roots pumps can all be transformed into dry vacuum pumps.

Pumps that do not use water and a vacuum generation media are dry vacuum pumps. Since dry pumps do not generate water pollution, the vacuum industry is moving towards dry technology. However, despite the many kinds of dry vacuum pumps available, each one has its own limitations. None of the dry vacuum pumps have a high suction capacity (bigger than 3000 m3/h) or sufficient vacuum level (10 Pa or better), that is tolerant to corrosion, sticky materials and dust at the same time. This limits the application of dry vacuum pumps in industrial applications. Therefore, in terms of overall suction capacity, powder and corrosion handling in all industrial applications, the dry vacuum process is still used far less than other pumps that involve water or oil. This causes those industries to remain major sources of pollution to the world.

The roots vacuum pump is a very popular dry vacuum pump. It has the biggest suction capacity in general among all pumps, a very high vacuum level up to 0.01 Pa, and is very resistant to corrosion and dust given the same application conditions. However, limited by its structure, unlike the other pumps mentioned above, this type of pump cannot discharge the gas directly to the atmosphere unless a backing pump exists. Although the pre-inlet air cooling roots pump is one kind of "roots pump" which can discharge gas directly to the atmosphere, it needs the discharged air to be cooled and then reintroduced back to the pump body to cool the pump to prevent the pump from an overheat failure. Therefore, it is inefficient and can only achieve a very rough vacuum to only 10-15 kPa level with excess noise and a high energy consumption, making it non-conducive for most processes.

The multi-stage roots pump is a decent dry vacuum pump. However, it shares two coaxial axles across all vacuum chambers and it has a limited flow path, limited number of stages and limited suction capacity, making it too narrow, small, and crowded, with too many dead corners in the air flow path. In addition to all of these characteristics, with the pump structure, the heat will kill the preset clearance among all chambers when the pump works hard. Therefore, a large-scale multi-stage roots pump cannot be made.

To avoid the limitation of the multi-stage roots pump, a separated multistage roots pump Japanese invention has been developed. It is a group of independent roots pumps combined with heat exchangers to form a type of multistage roots pump. However, it is not a pump unit, but a normal multistage pump set system. The business named in this application in the last several years tried to sell such a concept to customers, but in vain. Almost all customers want to have a single pump, not a set of pumps that need to be installed together on-site. In addition, this multistage group roots pump is also limited to a 0.1 mm clearance between the blade and pump case and a different rpm, but the size of each chamber remains the same. Such a pump is designed for the semiconductor industry, not for chemical, metallurgy, edible oil, power industry, or others.

The aim of this invention is to make a dry vacuum pump that can run by itself without a backing pump, and has as big as a 10,000 m3/h suction capacity, as high as a 1 to 10,000 Pa vacuum, and is still as resistant to corrosion and dust as the best roots pump can do among all dry pumps available today. It is made by modularized components but assembled into one single unit solid pump ready for use.

BRIEF SUMMARY OF THE EMBODIMENTS OF THE INVENTION

In a variant, an integrated modularized multiple-chamber vacuum pump comprises at least two non-coaxial vacuum chambers; one or more motor(s); an outlet; an inlet; at least two axles; wherein each vacuum chamber has a pair of lobes; wherein all of the chambers are integrated into one solid piece; wherein each chamber has an inlet and an outlet; and wherein gas flows into the inlet on one of the chambers, through the pump and out of the outlet on one of the chambers.

In another variant, a first vacuum chamber is a first stage in an arrangement of independent vacuum chambers, a second vacuum chamber is a second stage, and each respective vacuum chamber in the arrangement is a respective stage.

In a further variant, in a four-stage arrangement, stages one and three share a first motor and stages two and four share a second motor with a lower RPM than the first motor and in a different direction than the first motor; and an air flow is suctioned from stage one, to stage two, to stage three, and to stage four.

In yet another variant, in a four-stage arrangement, stages one and three share a first motor and stages two and four share a second motor; stages two and four are smaller than stages one and three; and an air flow is suctioned from stage one, to stage two, to stage three, and to stage four.

In another variant, the RPM and chamber sizes are determined based on an expected compression ratio between the chambers.

In a further variant, in a two-stage arrangement, stages one and two share one motor and one axle; and an air flow is suctioned into an inlet in stage one, through an inlet in stage two, and out an outlet in stage two.

In yet another variant, stages one and three share one axle but the lobes on each chamber turn in opposing directions, and stages two and four share one axle but the lobes on each chamber turn in opposing directions.

In another variant, gas flows from stage one into an inlet on stage two, then into a pipe connected from stage two to an inlet on stage three, and then into an inlet on stage four.

In a further variant, chambers can share motors and axles using a power transmission mechanism.

In yet another variant, each chamber has a motor that is either fixed-RPM or variable-frequency programmable.

In another variant, each chamber uses a roots booster design.

In a further variant, an outlet of a first pump is connected, by roots pumps, to an inlet of a second pump.

In yet another variant, the outlet of a first stage is directly connected to the inlet of a second stage.

In a further variant, the outlet is powered by a motor, gear transmission, or belt drive system.

In another variant, a side of each chamber has a water-cooling jacket.

In a further variant, a pulling screw rod connects at least two stages together.

In yet another variant, a first chamber is positioned vertically to a second chamber; the chambers are connected by a pair of bolts and pins; and a water jacket of the first chamber is connected to a water jacket of the second chamber.

In another variant, a first chamber is positioned horizontally to a second chamber; and each chamber has an endplate at its end.

DETAILED DESCRIPTION OF THE EMBODIMENTS OF THE INVENTION

Figure 1A:
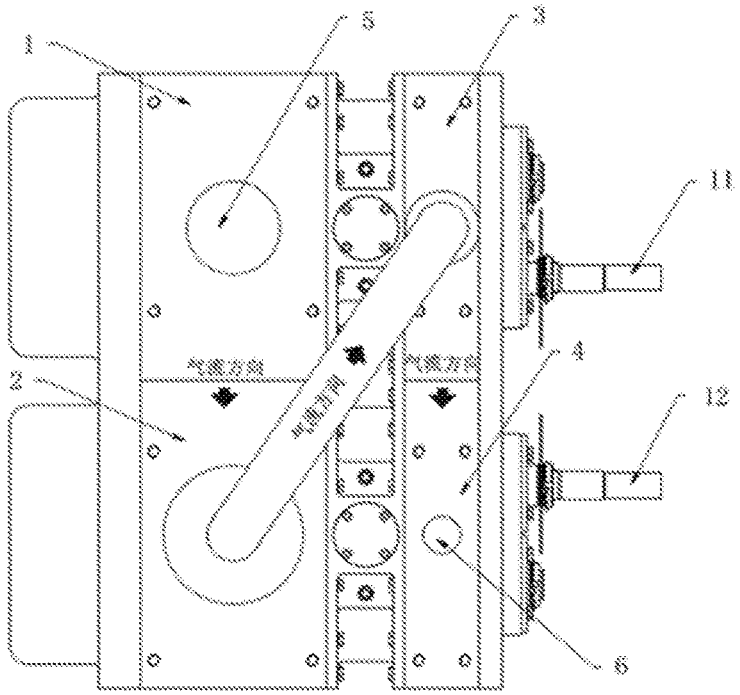
FIG. 1*a* is a view of a 4-stage MINCMC dry vacuum pump structure.

The following reference numbers refer to elements illustrated in the drawings.

1 Stage 1 chamber
2 Stage 2 chamber
3 Stage 3 chamber
4 Stage 4 chamber
5 Inlet on stage 1 chamber
6 Outlet on stage 4 chamber
11 Shaft on stage 3 chamber
12 Shaft on stage 4 chamber
16 bottom of chamber
17 water cooling jacket
18 chamber case/body
19 inlet/outlet
20 outlet/inlet
21 inlet/outlet
22 water jacket
23 seal
24 hole
25 pin
26 bolt
27 end plate In a variant, as generally depicted in FIGS. 1-8, a MINCMC dry vacuum pump with at least two modularized vacuum chambers that do not share any axial-like multi-stage roots pump, screw pump, claw pump and scroll pump, which all have one pair of common drive and non-drive co-axials, or, at least, do not share all axles. A single vacuum pump designed for very low pressure needs to have modularized stages for compression/suction. According to Boyle-Markitte's Law for isothermal conditions, $P_1V_1=P_2V_2=P_3V_3=P_4V_4$. Here $P_1$ represents an atmosphere of 1013 mbar. $P_4$ is the high vacuum pressure at inlet of 1 mbar. If one attempts to achieve the pressure by just one stage, then the air needs to be compressed 1013 times. According to the temperature—pressure change formula, $T_1=T_2*(P_2/P_1)^{0.286}$. The discharge temperature will be increased by 7.2 times to 1800° C. This is not practical. Therefore, to achieve pressure within 1 mbar, the dry screw pump needs five stages. A scroll pump, a modularized stage roots pump, and claw pump all need three or more stages. includes at least two vacuum chambers with roots type lobes inside to share the total pressure on the pump and form a modularized integrated dry vacuum pump (MINCMC). The higher the intended vacuum level, the more stages are needed.

In another variant, the pre-inlet air cool roots pump has only one stage. However, its ultimate inlet pressure is only 150 mbar or so, and its discharge temperature is as high as about 220° C. Thus, it needs a dedicated heat exchanger to cool the discharged air and return the cooled air back to the pump in order to cool the pump, to avoid the pump sticking up from thermal deformation. This decreases the pump work efficiency because a large portion of the air discharged comes back to the pump.

In a further variant, the reciprocating dry pump is a cylinder pump. The inlet pressure is about 40 mbar, which is not good enough for many vacuum processes. It also has quite a high temperature because at the lower pressure stage, the mass of the gas is less and the total compression heat generated is less. Therefore, it can take a higher pressure difference. However, at the rough vacuum level, the situation is just the opposite. Therefore, a smaller compression ratio is required. MINCMC gives flexibility to the designer to manage an ideal compression ratio at different vacuum levels for the best performance. No other kind of pump has such flexibility.

In another variant, referring to FIG. 1*a*, stage 1 and stage 3 turn the same direction because they share the "same axle" (inside the axle can be two pieces only joined together between the two chambers). The drive of stage 2 and stage 4 turn to an opposite direction as they share another same axle. Thus, the four chambers do not share one pair of co-axial axle(s) among all stages, compared with a modularized roots pump, a claw pump and a screw pump. This is the main characteristic of the present invention that has many advantages.

Figure 3:
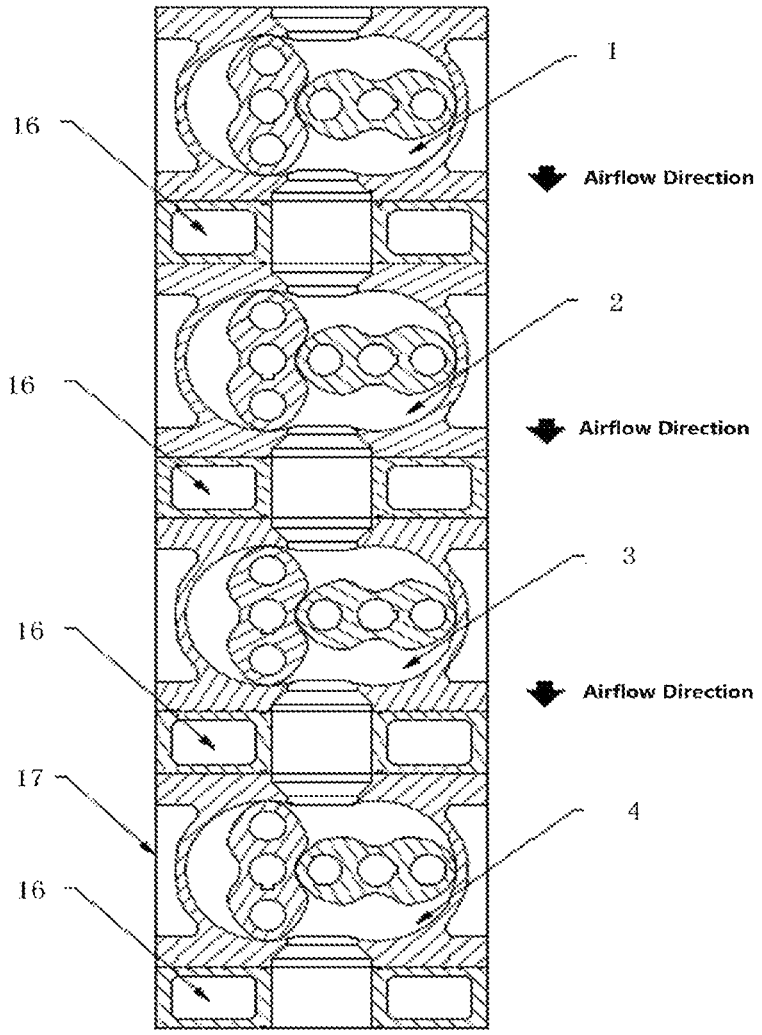
FIG. 3 depicts a complete non-co-axial MINCMC dry vacuum pump structure.

In yet another variant, referring to FIG. 3, each pair of lobes in the chambers can be driven by all different RPM adjustable motors, e.g. a VF motor, through a programmable control unit at any given time or pressure as desired. Such flexibility and optimization ability do not exist with other type of dry vacuum pumps available on the market. This is the mechanism of this invention; a speed (equivalent to volume) and pressure of each stage chamber can be constantly changed to a capable dry pump with modularized chambers among them, but consolidated into one unit. All chambers or, at least, some chambers do not share a co-axial drive, briefed as the MINCMC dry pump.

Ideally, in another variant, the MINCMC pump can use all different kinds of motors for different size chambers at different RPMs for all design and operation flexibilities. However, one can also achieve different compression ratios from combinations of different fixed RPMs from a transmission box and the different sizes of the chambers for certain design flexibility. Considering the cost of the transmission, the advantage of the independent motor driven by variable frequency control, and the overall large suction speed achieved by the MINCMC pump, either choice is justifiable for this new technology.

In a further variant, the invention includes (but is not limited to) the following options: the number of stages, motors, or transmission and their turning directions and RPM, chamber size, between the stage compression ratio, and vertical stack up or side-by-side or off-center arrangement. These are just specific arrangements based on the MINCMC idea. In real applications, one can choose a combination of the all above-mentioned varieties (but not limited to these) to form a best-fit specific MINCMC dry vacuum pump. However, the most recommended is that the air path is up and down with the shortest possible straight line.

In another variant, the MINCMC dry pump follows the same hydrodynamic principle as that of a multi-stage roots pump, a screw pump, a scroll pump and a claw pump.

In another variant, the MINCMC pump has its main gas flow direction arranged from above, below, or on the side of the chambers, with at least two of them in series, and can discharge to the atmosphere directly from its last stage discharge outlet without a backing pump.

In a further variant, the MINCMC pump also uses either independent motors with different speeds (variable frequency motor can be used), or a single motor with all chambers driving through a differential transmission gearbox or pulley and puller mechanism to achieve different RPM in different chambers for variable suction speed in different running stages of the pump, to always allow a best-fit compression ratio combination of the chamber speed.

Figure 1B:
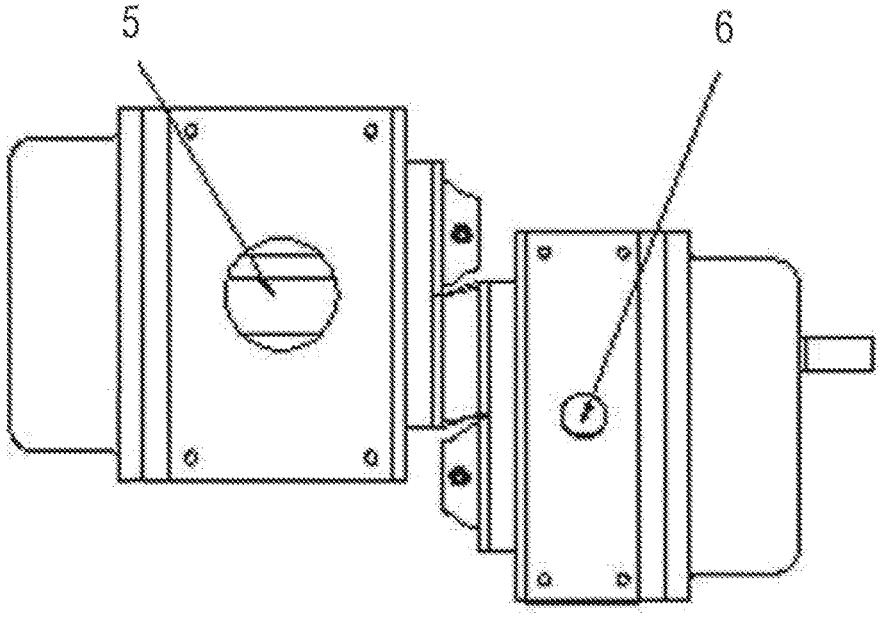
FIG. 1*b* is a top view of an inlet and outlet configuration on a pump structure in either a 2- or 4-stage MINCMC dry vacuum pump.

In yet another variant, referring to FIG. 1*a*, the pump has four independent vacuum chambers. They are labeled as stages 1, 2, 3, and 4. In this case, stages 1 and 3 share one motor with a high RPM to run in one direction. Stages 2 and 4 share another motor with a slower RPM in a different direction. These two motors are running in different directions. This arrangement allows the suctioned air to flow from the high RPM larger chamber stage 1 to the slower RPM chamber stage 2. Then the air goes to the smaller stage 3 chamber but with much a higher RPM. Lastly, the air goes to the same size stage 4 chamber, but with a slower RPM there. FIG. 1*b* shows the air goes into an inlet on the stage 1 chamber 5 and out the outlet on the stage 4 chamber 6. In the specific design, the RPM and the sizes of each chamber can be decided based on expected compression ratio between chambers.

Figure 2:
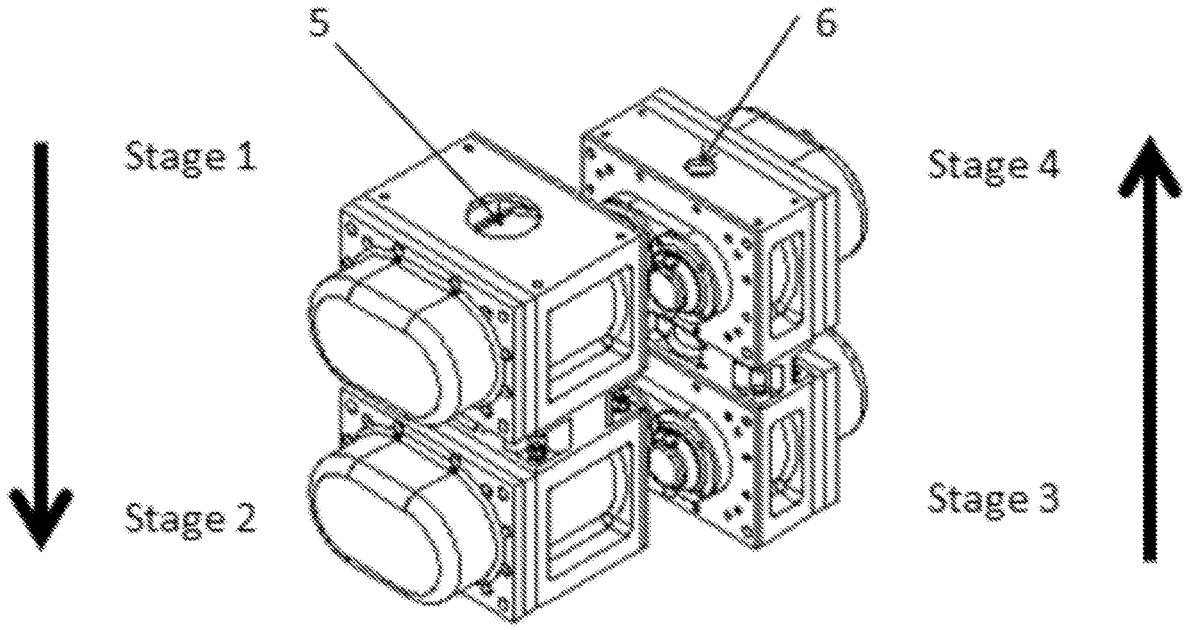
FIG. 2 is a view of a 4-stage MINCMC dry vacuum pump structure.

In another variant, referring to FIG. 2, the stage 1 chamber and the stage 2 chamber share one axle and a motor. However, the air flow of chambers 1 and 2 moves in opposite directions because of the offset layout and the non-driven impellers of each chamber that turns in opposite directions after the gear transmission of each roots chamber. Thus, the air flow will be suctioned into the stage 1 chamber through inlet 5 and pushed out to the stage 2 chamber inlet down under, and then discharged out through outlet 6.

In a further variant, referring to FIG. 2, if stages 3 and 4 are present, then the layout can be as in the lower chart of FIG. 2: stage 1 and stage 4 share one common axle, but the lobes turn in opposite directions. Stage 2 and stage 3 share one common axle, but the lobes turn in opposite directions. The outlet of chamber 1 is connected with the inlet of chamber 2. Then, the outlet of chamber 2 is connected with the inlet of chamber 3 by a pipe. The outlet of chamber 3 is connected with the inlet of chamber 4. The gas flow direction is shown as depicted by the arrows in FIG. 2.

In yet another variant, in real applications, depending on the level of vacuum needed, the number of stages can be 2-6 or even more. Some of them can share driving axles and motors through power transmission mechanism. In other situations, each stage chamber may need one-on-one driving motors.

In another variant, to be more flexible and optimal, each of these chambers uses a roots booster type of vacuum design, while the motor can be either fixed-RPM or variable frequency control-programmable.

In a further variant, referring to FIG. 3, a dedicated customized design or a setup via the available existing ELIVAC high pressure difference roots pump with a discharge end after cooler set. A MINCMC vacuum pump is stacked up and connected by modularized roots pumps with each outlet connected to the inlet of the next stage pump.

In yet another variant, referring to FIG. 1*a*, stages 1 and 3 are connected with an independent motor, gear transmission, or belt drive system. To account for the heat generated by gas compression, on the side of each chamber, there is a water cooling jacket 17. As the heat mostly concentrates in the discharge area where gas is compressed the most, a water cooling jacket is arranged in the bottom of the chamber 16.

Figure 4:
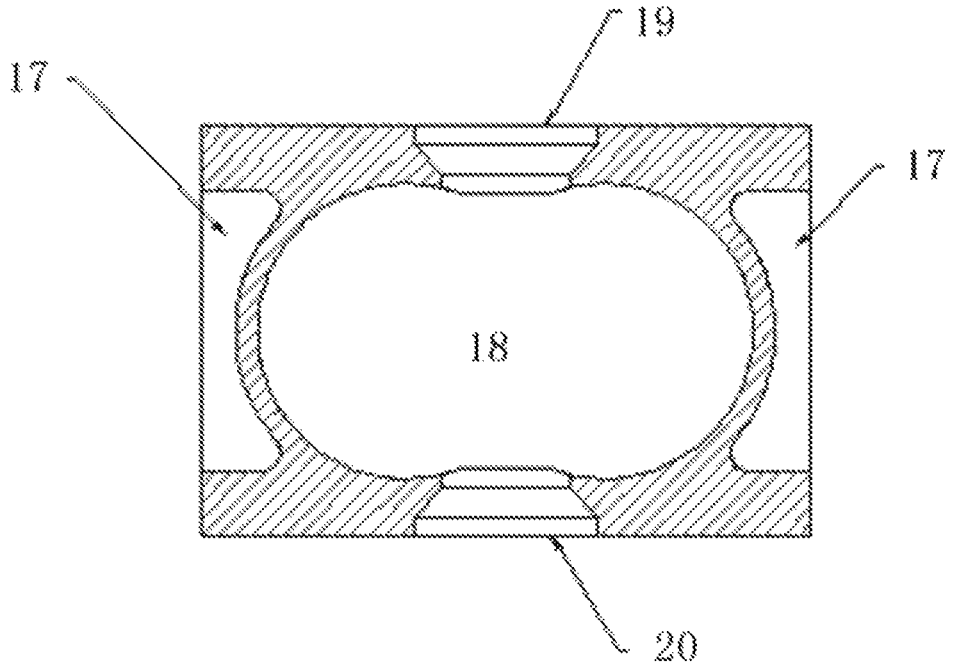
FIG. 4 depicts one type of MINCMC dry vacuum pump chamber with a water channel outside of a case.

In another variant, referring to FIG. 4, there is a chamber case 18 for one stage with an inlet/outlet 19 and an outlet/inlet 20. A cooling water jacket 17 is around the chamber. In fact, when configuration is required, the outlet 19/20 can also be custom-made to the side as a side discharge.

In a further variant, referring to FIG. 5, a cooling structure comprising a chamber case/body 18 having an inlet or outlet 21 on, above, or below the case 18. The cooling structure also has a water jacket on the side 22 and a gas seal 23. The pulling screw rod connects stage moduli together through holes 24.

Figure 5:
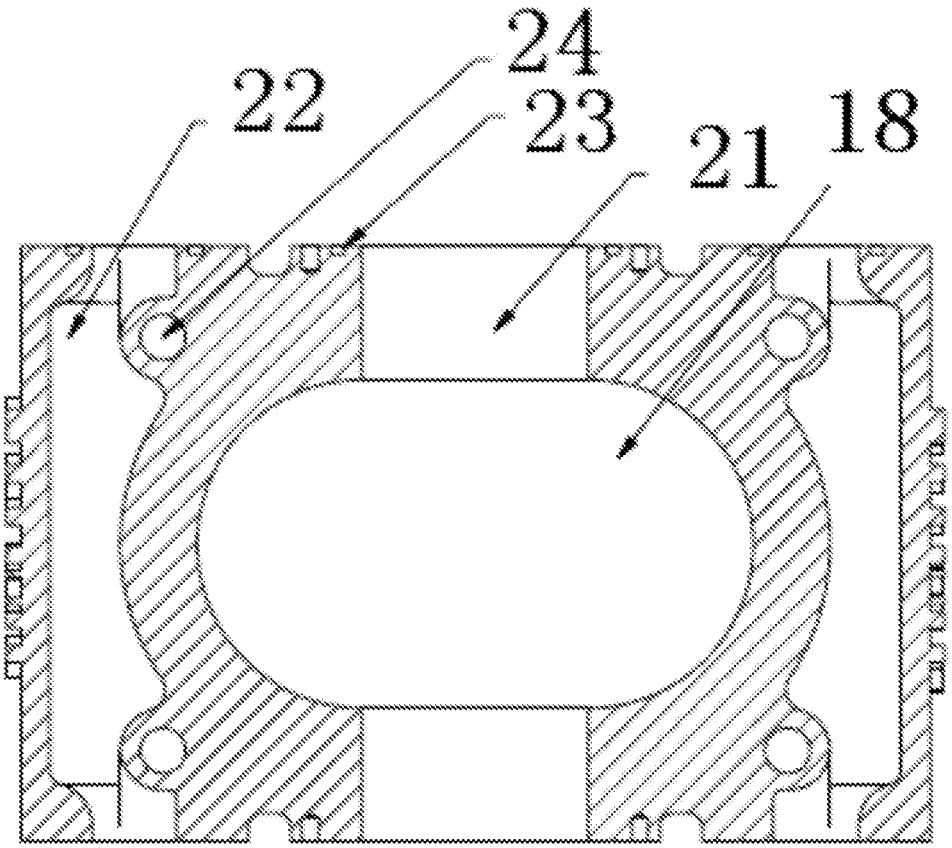
FIG. 5 illustrates another type of MINCMC dry vacuum pump chamber with a water channel outside of a case.
Figure 6:
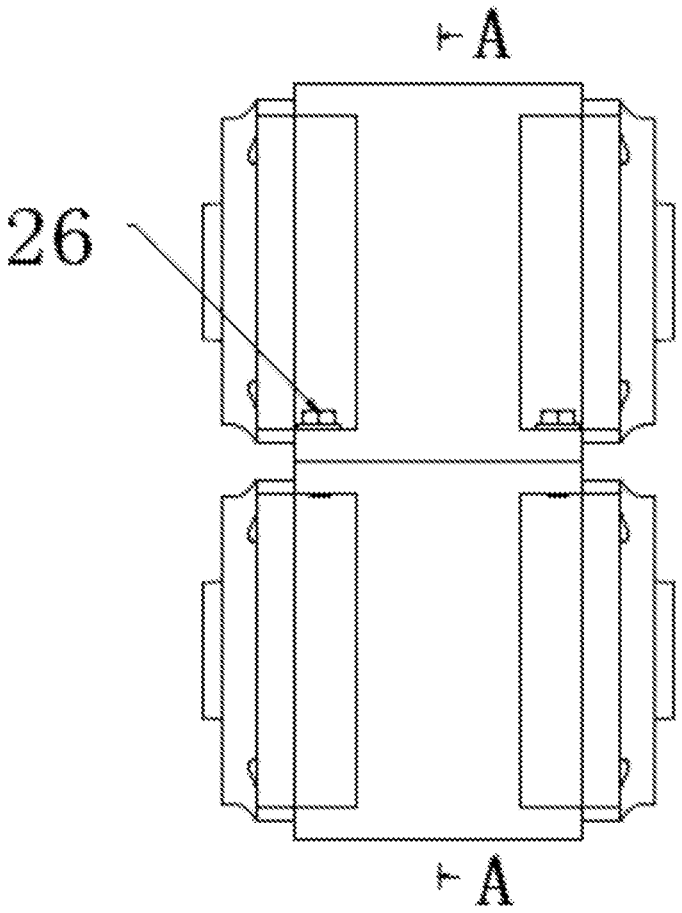
FIG. 6 illustrates an upward and a downward connection between two MINCMC chambers.
Figure 7:
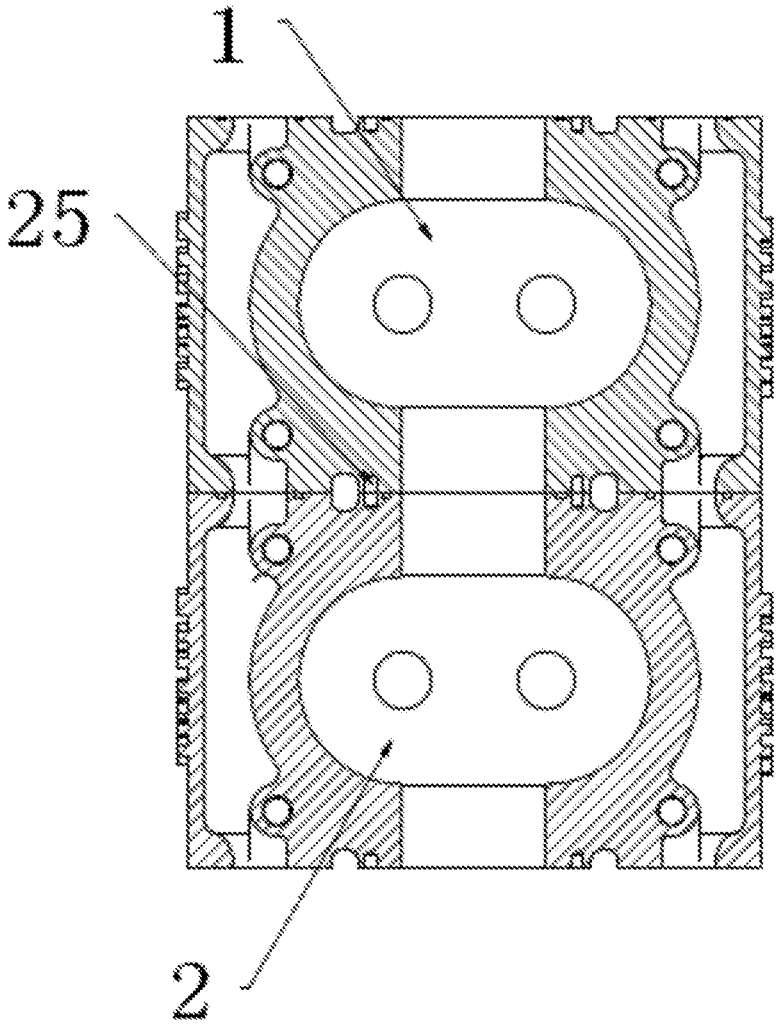
FIG. 7 depicts a cross section of the upward and the downward connection between two MINCMC chambers.

In yet another variant, referring to FIGS. 5-7, two MINCMC chambers are configured parallel to each other. The upper chamber 1 and the lower chamber 2 are connected to each other by bolts 26. There are also pins 25 between the chambers to ensure the chambers are aligned properly. The water jackets 22 of the two chambers are connected.

Figure 8:
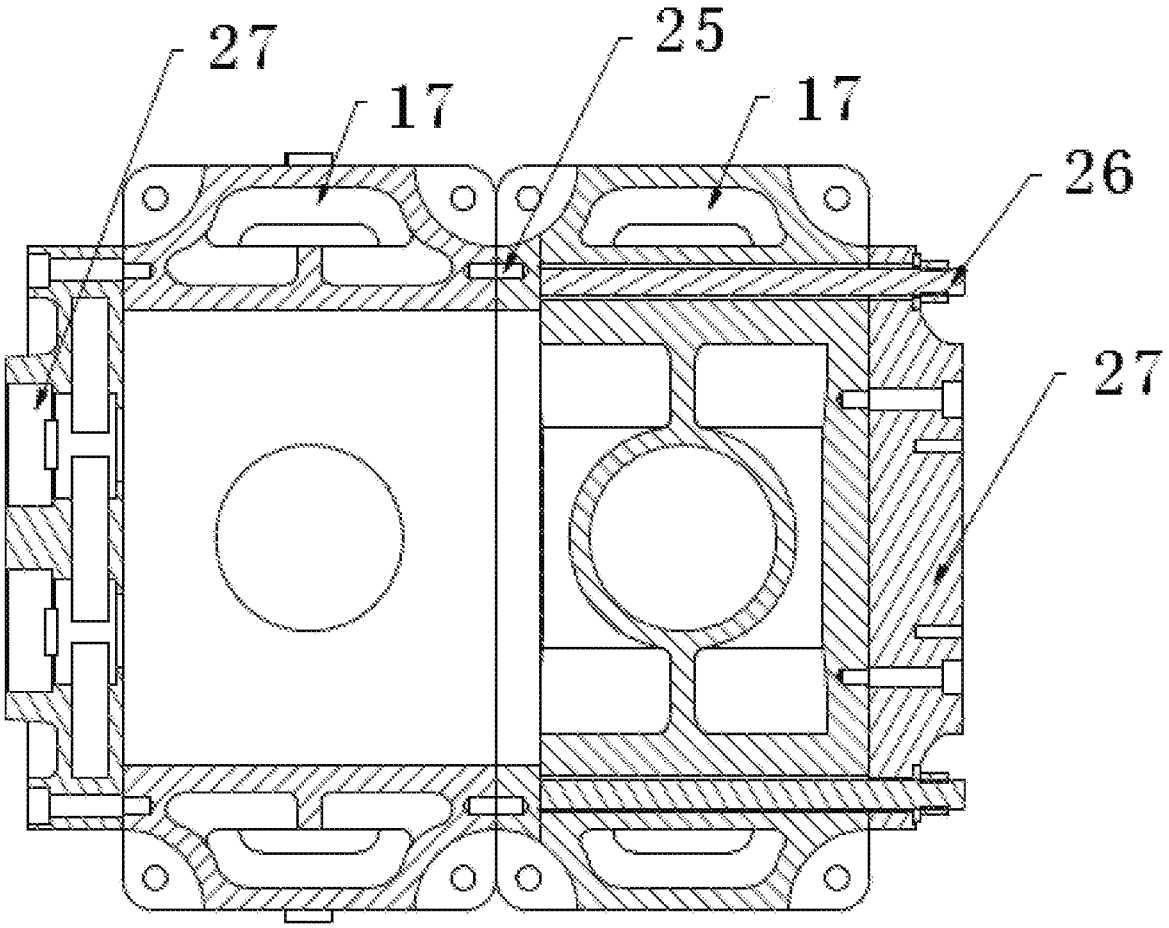
FIG. 8 depicts a horizontal connection between two MINCMC chambers.

In another variant, referring to FIG. 8, the two chambers of FIG. 5 are configured horizontal to each other. The end plates 27 are at the end of each chamber.

Advantages of the MINCMC Dry Vacuum Pump:

1) The MINCMC pump has a very high volume efficiency and can achieve much higher speed than all other dry pumps.

The present invention adopts a roots pump mechanism at each of its stage chambers. The advantage of such a choice is that it is possible to achieve up to tens of thousands cubic meters per hour of suction speed. When a set of modularized chambers are used with non-coaxial axle sets that can be driven at different RPMs, there is an option to not only to spread out the overall pressure to the modularized stage vacuum chambers, but also to change the suction speed of each chamber by changing its size and/or RPM to achieve an optimal real-time compression ratio among stages for the best performance.

As the MINCMC adopts the roots type of vacuum chamber design, it has good qualities of the roots pump, namely a very high volume efficiency. Each time the lobe completes a turn, it has about a 52-54% effective gas volume in geometric theory, while that of the screw pump is only 15-25%. This means that with the same suction speed ability and the same design standard in the sense of strength and heat management, the MINCMC has less weight than the screw pump.

Also, the MINCMC inherits another advantage of roots pump: it can achieve a very high speed by using bigger chambers and lobes. But all other dry pumps, including screw, scroll, rotary vane, claw and multi-stage roots pumps cannot be built to be too big because of the limitation of the commonly-shared axle.

The screw pump has a fixed compression ratio between each pitch of screw. The scroll pump has the same compression ratio between each scroll circle. The multi-stage roots pump has a fixed compression ratio between each stage, once these machines are built, as does the claw pump. The MINCMC, as discussed previously, does not have a co-axial axle set like all other pumps have. It gives the pump an opportunity to manage variable speeds of different chambers by different drives at different RPMs (by variable frequency motor, for instance) to achieve the different compression ratio at different times, or all the time, to maximize performance at different vacuum levels. The advantage that the MINCMC gives by such a flexibility is that, at the different vacuum levels, the biggest and most comfortable compression ratios between stages are different. With variable speeds of the chambers and compression between chambers, the MINCMC can optimize the performance of the pump by evening out the load and heat all the time, unlike all other dry pumps where everything has been fixed because they all have co-axials that force all stages to run at the same RPM.

2) The MINCMC pump has a much stronger tolerance to dust and sticky materials than other dry pumps.

In such a structure and mechanism, as the dust, small powders, and other foreign materials along with the gas are moving in the direction perpendicular to the wheel and directly in and out the large roots type of inlet and outlet, there is no need to make any sharp or awkward turn, and the two lobes meet only once every half revolution. The dust in the MINCMC will have a hard time hanging onto the wheel to stay in the chamber (FIG. 3). With similar reason, MINCMC is also more tolerant to sticky materials and corrosive materials than other screw dry vacuum pumps.

In the screw pump, as most screw pumps are designed in a horizontal way, the gas flow moves along the horizontal screw to the end. One problem is, in the situation of gas content (dust, water, and sticky materials), the direction of the force of gravity exerted on these mass are perpendicular to the gas flow direction. Therefore, these solid or sticky materials tend to deposit on the bottom side of the screw pump chamber. The screw edges will then push and drag the dust toward the end of the pump case. Another worse problem is that in the end of the screw pump chamber, the end plate is a wall against the gas flow. Therefore, water and sticky materials been push and dragged here against the dust. Even worse, most screw pump designs put only one small discharge hole on one side of the end of the two screws, with no hole on the other side. This forces the solid materials to deposit and stay there, although most of the smaller materials can be blown out of the discharge hole. However, as time goes by, the solid and sticky materials accumulate here, jam the thin clearance, and then cause high current and coating wear-off. In the end, the circuit may be broken, the screw may be worn out badly, and the vacuum can no longer be achieved. This is one of the reasons why the screw pump cannot be used more widely in the chemical and pharmaceutical industries.

On the contrary, the MINCMC pump has a straightforward gas flow path in line with the big inlet and outlet without any dead wall right against the flow. The flow is perpendicular (including the large angles, if preferred) to the pump lobes. The spin door-like mechanism allows the gas with dust and particles to go through the pump very easily. Even better, in most cases, the gas flow is in parallel with gravity, and gravity can help the dust and other solid materials go through the outlet, instead of staying inside the pump chambers. As each MINCMC chamber can be driven independently at any speed assigned, one can take advantage of this to prevent the dust from staying. One can also purge the dust out of the pump during operation or maintenance.

The issue with all other dry vacuum pumps having co-axials is that they are susceptible to accumulation of dust and particles. The main reason is that none of them has an easy straight path for gas flow. All these expensive precision pumps have many vertical "walls" in the path of the gas flow that force the gas flow to make 90 degree turns. When the gas flow does this, the dust and particles head on the "walls", slow down, and tend to stay. What makes the situation worse for the screw pump, scroll pump, and multi-stage roots pump is that most of their gas flow direction is not in line with gravity, but is instead horizontal. Sometimes the MINCMC flow occurs from bottom to top through a smooth pipe, as the flow direction against gravity direction is still in parallel.

3) The MINCMC pump has modular design advantages and optimization ability.

The present invention uses the modular concept. The components are standard and exchangeable. The number of stages and sizes and RPM for all combinations of suction speed and level of vacuum can be chosen. The basic components are easy to manufacture. For example, at rough vacuum, the compression ratio between chambers cannot be too high because the mass air flow creates much heat that can damage the pump. However, at the higher vacuum level, the air is thin, and the pump can have a much higher compression ratio. As the axles do not have to be shared, one has many choices to arrange the MINCMC in any way they want to make the shortest airflow path with minimum flow loss. This is an obvious advantage over the multi-stage roots pump with a shared common axle and fixed RPM.

4) The MINCMC pump has an integrated modular design.

The present invention makes use of an integrated modular design that is compact, solid, and free of site assembly, unlike a vacuum system formed from a number of separate, independent pumps. It is a modularized, but integrated single unit like a common multiple chamber/stage dry vacuum pump.

5) The MINCMC pump has the highest level of displacement efficiency compared with the piston, screw and multi-stage roots pump (some with pre-inlet air cooling)

There is no air trapped within the MINCMC chamber, as would be in the two ends of the piston pump. There is much more displacement efficiency than in a roots type chamber of a screw pump. There is much less air flow resistance between chambers, as the flow outlet is always arranged to the closest inlet directly nearby, unlike that of the multi-stage roots pump, where the outlet air has to go through a long pipe all the way to the opposite side of the pump body. This is because the inlet and outlet of a multi-stage roots pump with a shared common axle can only have them in opposite sides.

6) The MINCMC pump can discharge directly to atmosphere, as compared with the roots pump.

From the nature of the configuration, the roots booster vacuum pump cannot be used by itself as it cannot discharge gas directly to the atmosphere without a backing pump. However, with at least two stages, the multi-stage MINCMC can be used as an independent vacuum pump and provide sufficient vacuum power. Of course, when using few stages, each roots chamber has to be designed and made strong enough to bear the load.

7) The MINCMC pump is more efficient, quieter, and can achieve a higher vacuum level compared with a pre-inlet/gas-cooled roots pump.

A pre-inlet/gas-cooled roots pump is able to discharge gas directly to the atmosphere but has very low efficiency as the too-hot gas discharged has to be cooled through a dedicated heat exchanger and then charged back to the pump to reduce the pump temperature to avoid a pump jam. But the MINCMC does not do this, as there are at least two stages to share the pressure, and there is less overheating. It does not have cooled air that needs to be recharged back to the pump, which means higher efficiency. The pre-inlet gas-cooled roots pump was intended to accomplish the whole job in one turn/stage. Compared with multi-stages in the screw, claw, scroll and multiple stage roots and MINCMC pumps, the noise of the pre-inlet gas-cooled roots pump is very loud. But the MINCMC evens out the total pressure over a few stages; therefore, the noise level is by nature much lower than the gas-cooled roots pump. Perhaps the most important advantage of the MINCMC pump over the gas-cooled roots pump is that the single-stage push through style of a pre-inlet gas-cooled roots pump cannot hold the gas tightly. The gas pushes back by atmosphere, therefore, the gas-cooled roots pump cannot reach a higher vacuum level than 150 mbar, or else the suction speed drops to zero. But the MINCMC can have as many stages as needed, so it is a relay for each chamber to absorb a portion of the pressure load. Therefore, a four-stage MINCMC pump can reach the vacuum level within 10 mbar.

8) The MINCMC pump has less of a chance to be corroded as badly as other dry pumps.

On the screws in the screw pump, there are very long screws on permanent corners and edges. In those areas, the corrosive material tends to stay and corrode and wear the screw edges all the time. Worse than this, from the nature of the electrical-chemical process, the corners and edges are easiest to be corroded. Once the corners and edges are worn out, the vacuum level will dramatically drop, and the back-flow will dramatically increase. In the MINCMC pump, as the roots lobe is much simpler without such corners and edges, it has less of a chance to be corroded as badly as would a screw pump. As the roots pump seals the inlet and the outlet by the tip of the pair of lobes within the pump body, so the MINCMC pump chambers have a much bigger area than the screw edges or corners while the chamber of the total MINCMC is bigger than that of other dry pumps. In the same corrosive condition, not only does the roots chamber have less of a chance to be corroded as badly as the sharp corners and edges of the screw pump, but also the ratio of the backflow to the overall flow in the MINCMC is much better off than that of the screw pump.

In the multi-stage roots pump situation, similar to what was discussed with dust earlier, the corrosive material is also likely to stay in the maze-type chamber and continue to corrode the pump. The MINCMC has an easier way to allow the corrosive material discharge to outside.

The scroll pump situation is much worse. In fact, most scroll pump manufacturers strictly forbid any use of corrosive media.

9) The MINCMC pump has a better gas flow path than the multi-stage roots pump, and can be made much bigger.

The MINCMC has a better gas flow path than does the multi-stage roots pump. As the multi-stage roots pump has a pair of co-axial axle set, all stages have to run in the same direction, meaning that all the discharge outlets are down under and all the inlets are on top, or vice-versa. This means that each discharge has to be connected by a pipe and turned a few times all the way back up on or down to the other side for the next chamber. However, the MINCMC has the flexibility for a designer to arrange straight and shorter inter-stage connections. Most likely, a lot of length is aligned with gravity. In this way, not only is the pipe resistance low, but also the dust and other materials have less of a chance to deposit as there are fewer turns and corners, and lower speed reduction along a horizontal path or a dead end wall.

Due to the limitation of the co-axial multi-stage roots pump in the number of stages and size, an additional advantage of the MINCMC over the multiple stage pump is that it can be made in as many stages as is necessary, and that the pump suction capacity can be made to be many times bigger than that of the co-axial.

10) The MINCMC pump allows bigger chamber size and more stages than other dry pumps to achieve a higher vacuum level and higher speed economically.

Since the screw, scroll, claw, and multi-stage roots pumps all have co-axials, none of them can be made too large at a decent cost. For any modern machines, as the work size increases, the machining cost also increases. Also, as the rotary parts have too big of a diameter, the dynamic eccentric force will be increased by a square power. This is why the biggest screw pump commercially-made in the world pumps at a rate of only about 2500 $m^3/h$, and the scroll pump pumps at a rate of approximately 60 $m^3/h$. The manufacture has to fit all multi-stages onto one co-axial axle set. If each stage is too big, and a few stages are added together on the co-axial, not only is the machine cost much bigger, but also the dynamic eccentric force is too big to handle. But the MINCMC does not have such a limitation, as each stage can has its own axles, and each stage chamber can be as big as one set of axles can handle. Therefore, in theory, the MINCMC pump can be many times bigger than those other dry pumps.

11) The MINCMC pump is more efficient than the reciprocating dry pump.

Considering the reciprocating dry pump, the biggest problem is that the pump has no smooth movement. Each cycle time the cylinder changes its moving direction, it wastes energy and causes vibration. Then the variation creates a short life for the parts, and a high maintenance. The second problem is that the dead end residual gas cannot be pushed out of the pump and will expend when the cylinder moves away to other directions. This is also a waste of motion. On the contrary, all the MINCMC pump lobes turn to the same direction all the time continuously. Therefore, the MINCMC is a more efficient pump.

In addition, the two dead ends of the cylinder in the reciprocating pump are placed where air flow changes direction, and the dust and other solid, sticky, or corrosive materials are likely to stay and eventually jam or damage the cylinder. There is much less of a chance of this in the MINCMC situation because of its mechanism.

12) The MINCMC principle can be applied to other types of residual compression chamber pumps.

The same MINCMC principle can also be applied to the screw pump, the claw pump, and the scroll pump. For instance, instead of having five turn (stages) screws machined on one pair of co-axials of the screw pump, it is possible to make only one turn (stage) screw machined on one piece of axle to make one vacuum chamber. Then it can be connected together with another similar chamber for a two-stage non-co-axial screw pump. It will come out having better features. This same principle application to other types of pump chambers should also be protected by this patent application.

What is claimed is:

1. An integrated modularized multiple-chamber vacuum pump, comprising:

at least four non-coaxial vacuum chambers;

at least a first motor and a second motor;

at least two axles;

wherein each vacuum chamber of the at least four non-coaxial chambers has a pair of lobes;

wherein all of the vacuum chambers are integrated into one solid piece;

wherein each of the vacuum chambers has a respective inlet and an respective outlet; and wherein gas flows into the pump via the respective inlet on of a first one of the vacuum chambers, and out of the pump via the respective outlet on of a fourth one of the vacuum chambers;

wherein the first one of the vacuum chambers is a first stage in an arrangement of independent vacuum chambers, a second one of the vacuum chambers is a second stage, a third one of the vacuum chambers is a third stage, and the fourth one of the vacuum chambers is a fourth stage;

wherein the pump comprises four stages, wherein the first stages one and three the third stage share the first motor, and the second stages two and the fourth stage share the second motor with a lower RPM than the first motor and in a different direction than the first motor; and an air flow is suctioned from the first stage one, to the second stage two, to the third stage three, and to the fourth stage.

2. The vacuum pump of claim 1, wherein the pump comprises four stages, wherein the first and third stages share the first motor and the second and fourth stages share the second motor; the second and fourth stages are smaller than the first and second stages; and an air flow is suctioned from the first stage, to the second stage, to the third stage, and to the fourth stage.

3. The vacuum pump of claim 1, wherein the RPM and vacuum chamber sizes are determined based on an expected compression ratio between the vacuum chambers.

4. The vacuum pump of claim 1, wherein each of the vacuum chambers has a roots booster type of design.

5. The vacuum pump of claim 4, wherein a side of each of the vacuum chambers has a water-cooling jacket.

6. The vacuum pump of claim 4, wherein a pulling screw rod connects at least two stages together.

7. The vacuum pump of claim 1, wherein the outlet of the first stage is directly connected to the inlet of a-the second stage.

8. The vacuum pump of claim 1, wherein the first one of the vacuum chambers is positioned vertically to the second one of the vacuum chambers.

9. The vacuum pump of claim 8, the vacuum chambers are connected by a pair of bolts and pins.

10. The vacuum pump of claim 8, wherein a water jacket of the first one of the vacuum chambers is connected to a water jacket of the second one of the vacuum chambers.

11. The vacuum pump of claim 1, wherein the first one of the vacuum chambers is positioned horizontally to the second one of the vacuum chambers; and each of the vacuum chambers has an endplate at an end.

12. An integrated modularized multiple-chamber vacuum pump, comprising:

at least four non-coaxial vacuum chambers;

a first motor and a second motor;

at least two axles;

wherein each vacuum chamber has a pair of lobes;

wherein all of the vacuum chambers are integrated into one solid piece;

wherein each of the vacuum chambers has a respective inlet and an respective outlet; and wherein gas flows into the respective inlet of a first one of the vacuum chambers, and out of the pump via the respective outlet of a fourth one of the vacuum chambers;

wherein the first one of the vacuum chambers is a first stage in an arrangement of independent vacuum chambers, a second one of the vacuum chambers is a second stage, a third one of the vacuum chambers is a third stage, and the fourth one of the vacuum chambers is a fourth stage;

wherein the pump comprises four stages, wherein the first and third stages one and three share the first motor, and the second and fourth stages share the second motor; the second and fourth stages are smaller than the first and third stages; and an air flow is suctioned from the first stage, to the second stage, to the third stage, and to the fourth stage.

13. The vacuum pump of claim 12, wherein each of the vacuum chambers has a roots booster type of design.

14. The vacuum pump of claim 13, wherein a side of each of the vacuum chambers has a water-cooling jacket.

15. The vacuum pump of claim 13, wherein a pulling screw rod connects at least two stages together.

16. The vacuum pump of claim 12, wherein the outlet of the first stage is directly connected to the inlet of the second stage.

17. The vacuum pump of claim 12, wherein the first one of the vacuum chambers is positioned vertically to the second one of the vacuum chambers.

18. The vacuum pump of claim 17, wherein the vacuum chambers are connected by a pair of bolts and pins.

19. The vacuum pump of claim 17, wherein a water jacket of the first one of the vacuum chambers is connected to a water jacket of the second one of the vacuum chambers.

20. The vacuum pump of claim 12, wherein a first one of the vacuum chambers is positioned horizontally to the second one of the vacuum chambers; and each of the vacuum chambers has an endplate at an end.

* * * * *